US008485390B2

(12) United States Patent
Cronin

(10) Patent No.: US 8,485,390 B2
(45) Date of Patent: Jul. 16, 2013

(54) HINGE RING FOR PIVOTALLY COUPLING A CONTAINER LID TO A CONTAINER BOTTOM

(75) Inventor: Edward P. Cronin, Brodhead, WI (US)

(73) Assignee: J.L. Clark, Inc., Rockford, IL (US)

( * ) Notice: Subject to any disclaimer, the term of this patent is extended or adjusted under 35 U.S.C. 154(b) by 931 days.

(21) Appl. No.: 12/168,389

(22) Filed: Jul. 7, 2008

(65) Prior Publication Data

US 2010/0000993 A1 Jan. 7, 2010

(51) Int. Cl.
*B65D 43/16* (2006.01)
*B65D 51/04* (2006.01)

(52) U.S. Cl.
USPC ..... 220/845; 220/4.24; 220/4.22; 220/640

(58) Field of Classification Search
USPC ..... 220/845, 4.24, 4.22, 642, 655, 847, 220/640, 643; 16/225, 252, 253, DIG. 13
See application file for complete search history.

(56) References Cited

U.S. PATENT DOCUMENTS

| | | | | | |
|---|---|---|---|---|---|
| 2,490,746 | A | * | 12/1949 | Carpenter, Jr. | 220/845 |
| 2,737,311 | A | * | 3/1956 | Blacher | 220/845 |
| 3,334,714 | A | * | 8/1967 | Gordon | 190/117 |
| 3,944,105 | A | | 3/1976 | Chollet | |
| 4,351,165 | A | | 9/1982 | Gottsegen et al. | |
| 4,452,373 | A | | 6/1984 | Pearce et al. | |
| 4,546,874 | A | | 10/1985 | Kirchhan | |
| 4,563,381 | A | * | 1/1986 | Woodland | 428/156 |
| 4,905,861 | A | * | 3/1990 | Boxall et al. | 220/266 |
| 5,069,354 | A | * | 12/1991 | Tannenbaum | 220/4.22 |
| 5,211,302 | A | * | 5/1993 | Tiramani | 220/4.25 |
| 5,676,272 | A | | 10/1997 | Baerenwald | |
| 5,782,371 | A | | 7/1998 | Baerenwald et al. | |
| 5,794,814 | A | | 8/1998 | Baerenwald | |
| 5,855,766 | A | * | 1/1999 | Mamiye et al. | 206/581 |
| 6,772,905 | B2 | * | 8/2004 | Cheng | 220/840 |
| 7,047,576 | B2 | * | 5/2006 | Tavivian | 4/596 |
| 2001/0035424 | A1 | * | 11/2001 | Combe et al. | 220/835 |

* cited by examiner

*Primary Examiner* — Mickey Yu
*Assistant Examiner* — Niki Eloshway
(74) *Attorney, Agent, or Firm* — Reinhart Boerner Van Deuren P.C.

(57) ABSTRACT

A hinged connector for joining a metal lid and metal bottom to form a hinged container is provided. The metal lid and metal bottom have generally matching formed edges preventing interfitting of the container lid and bottom. The hinged connector is formed of plastic and includes a pair of ring members that are pivotable relative to one another via an integral hinge. The two ring members are continuous about a periphery that is generally shaped to the periphery of the lid and bottom. The ring members form seats for engaging the formed edges of the lid and bottom. The ring members securely grip the formed edges of the lid and body to form the container. By connecting the lid and bottom through the living hinge, the hinge connector allows the lid and bottom to pivot relative to one another between open and closed positions.

16 Claims, 11 Drawing Sheets

HINGE RING FOR PIVOTALLY COUPLING A CONTAINER LID TO A CONTAINER BOTTOM

FIELD OF THE INVENTION

This invention generally relates to containers and more particularly to metal containers.

BACKGROUND OF THE INVENTION

Thin-walled metal containers are popular for packaging certain items where the packaging is intended to have a degree of permanency. They are advantageous in that they provide good protection for the content, and they provide the opportunity to permanently print attractive designs on the container themselves or to have the designs embossed therein. The containers thus can be used for long periods of time. In the case where the contents are consumed after a short period, the containers are often kept for other storage purposes. Further, a metal container used for packaging retail products can provide an upscale or high-end feel to the packaging of the product that is being sold.

Thin-walled metal containers are typically made from thin metal sheets by deep drawing. Some of them have separable lids and bottoms. Others, including many low profile containers, have hinged lids that are not separable from the bottoms. Both hinged and non-hinged metal containers share the aspects that the lids are not identical to the bottoms because they are intended to interfit. Thus, two different tool sets are normally required to form a container, one for making the container lid, the other for the bottom. Typically, the bottom has an edge which is inwardly rolled or hemmed to avoid exposing raw metal edges, and sometimes has a ledge formed at the upper part to serve as a receiving area/stop for the lid. The lid or cover typically has a rolled or hemmed edge to also avoid exposing raw metal edges, and that edge is typically rolled outwardly, to leave the inside wall of the lid available to fit the container bottom. In the case of a hinged container, the lid further has a hinge half that interfits and an associated hinge half of the container bottom.

The hinged connection between the lid an the bottom of a hinged container facilitates repeated opening and closing of the container and also eliminates the possibility of mislaying the container lid. Hinged containers, however, are generally more expensive to make than non-hinged containers with separable container halves, due to the cost involved in forming the hinges. For example, the hinge on a low-profile metal container is typically intricately formed from metal tabs extending from the sides of the container halves. To form such a hinge, the sheet metal blank from which a container half is formed has to be processed to form the tabs, and the tabs are then rolled or otherwise processed to form a hinge half. Although the exact configuration of hinges on hinged metal containers may differ, the formation of such hinges generally requires extra metal processing steps and more complicated tool sets than those required for non-hinged containers.

Attempts to overcome the problems of trying to connect the lid and bottom of hinged and non-hinged metal containers have been tried. More particularly, U.S. Pat. No. 5,782,371 to the instant assignee of the present application attempts to provide a plastic hinge member that couples a container lid to a container bottom. The hinge member includes a living hinge between a partial segment and a full ring segment. The partial ring segment pivots relative to the full ring segment via the living hinge. Only a portion of a rolled or formed edge of the container lid is engaged by the partial segment while an entire portion of the other one of the container bottom or container lid is received or engaged by the full segment. In the closed position, the container lid or container body that is engaged with the partial ring segment, includes a portion that is engaged with a portion of the full ring segment. Thus, in this device, the full ring segment engages both of the container lid and container bottom. Further yet, the partial ring segment and full ring segments define channels that completely receive the rolled edges of the top and bottom of the container such that the plastic hinge member extends laterally outward beyond the metal container on all of the sides of them metal container.

The present invention relates to improvements over the present state of the art for hingedly connecting two metal container halves together that generally have similar shapes.

BRIEF SUMMARY OF THE INVENTION

The present invention has several aspects that may be claimed and stand as patentable independently and individually or in combination with other aspects, including but not limited to the following.

The invention provides a container that has a metal bottom and a metal lid that are coupled by a plastic hinge ring. The use of the plastic hinge ring allows the sidewalls of the lid and bottom to have a matching periphery that would otherwise oppose an inter-fit connection of the lid to the bottom. The plastic hinge ring can also provide a living hinge to permit the lid to pivot relative to the bottom so as to allow a user to selectively open and close the container.

In practicing one embodiment of the present invention, a metal container comprising a container lid and container bottom that are metal and a plastic hinge ring connecting the lid and bottom is provided. The container lid and container bottom each have a closed bottom and an annular sidewall terminating in a formed edge. The formed edges of the container lid and container bottom define a peripheral container shape. The formed edge of the container lid cannot be inter-fit into or receive the formed edge of the container bottom. The hinge ring pivotally secures the container lid to the bottom. The hinge ring has first and second continuous ring members and a living hinge integrally joining the ring members. The first ring member has an upward facing seat sized to securably engage the formed edge of the container lid and the second ring member has a downward facing seat sized to securably engage the formed edge of the container bottom. The container lid securably connects to the first ring member and the container bottom securably connects to the second ring member.

The seats of the hinge ring or hinge ring connector are preferably formed by spaced apart upstanding inner and outer walls. The outer walls being co-planar with the outer surface of the sidewalls of the container lid and container bottom to provide a generally smoother outer profile to the sides of the container.

In another aspect, the invention provides a hinge ring for connecting a container lid and container bottom that would otherwise not be axially inter-fit. One particular implementation provides a plastic hinged connector for joining a metal container lid and a metal container bottom to formed a hinged container. The container lid has a formed edge of a first given size and shape. The container bottom has a formed edge of a second given size and shape. The formed edge of the container lid defines a first peripheral shape and the formed edge of the container bottom defines a second peripheral shape. Typically, the first and second peripheral shapes are the same. The hinged connector includes first and second ring members joined by an integrally formed hinge. The first ring member is shaped to match the first peripheral shape and the second ring member is shaped to match the second peripheral shape. The first ring member forms a continuous structure bounding an aperture therethrough. The first ring member has an upward facing upper seat for receiving the formed edge of the container lid. The upward facing upper seat extends along all sides of the first ring member. The upward facing upper seat is on an opposite side of the first ring member as a first abutment surface. The second ring member forms a continuous structure bounding an aperture therethrough. The second ring member has a downward facing bottom seat for receiving the formed edge of the container bottom. The downward facing bottom seat extends along all sides of the second ring member. The downward facing bottom seat is on an opposite side of the second ring member as a second abutment surface. The first and second abutment surfaces face one another when the hinged connector is in a closed orientation.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
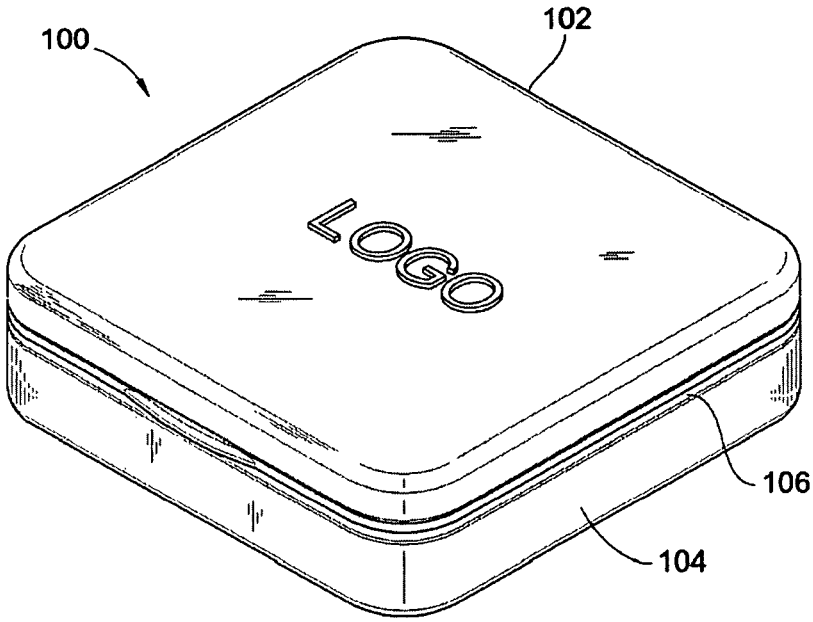
FIG. 1 is a top perspective illustration of an exemplary embodiment of a container in accordance with the teachings of the present invention with the container in a closed position.
Figure 2:
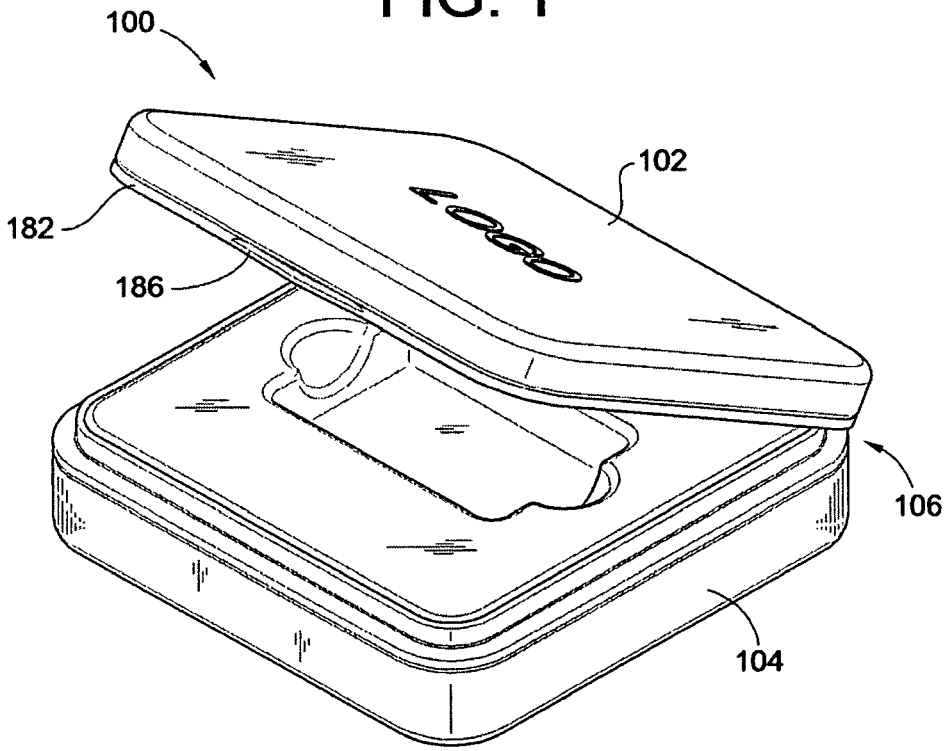
FIG. 2 is a top perspective illustration of the container of FIG. 1 in an opened position.
Figure 3:
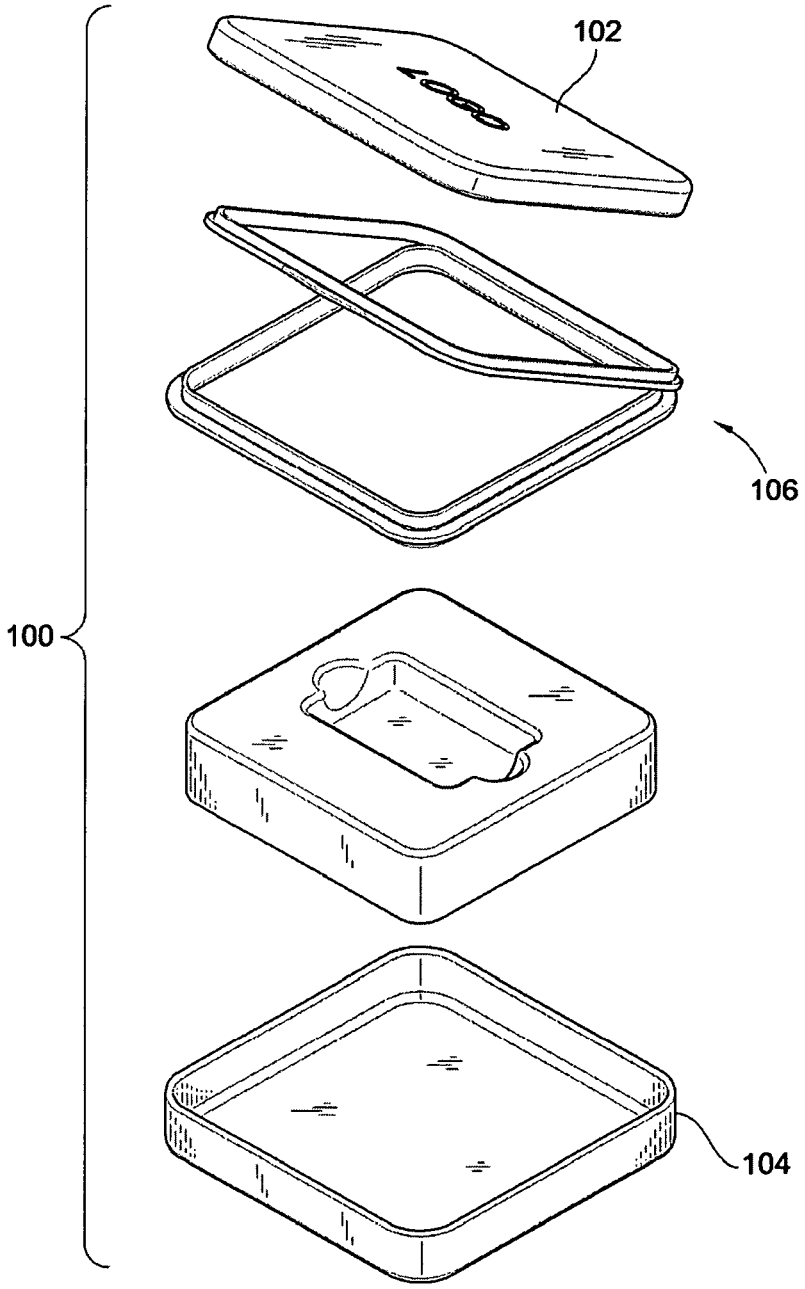
FIG. 3 is a top perspective illustration of the container of FIG. 1 in an exploded configuration with the hinge ring of the container in an open orientation.

FIG. 1 illustrates a container 100 constructed according to the teachings of the present invention. The container 100 generally includes a container lid 102, a container bottom 104 and a resilient hinge ring 106. The resilient hinge ring 106 joins the container lid 102 to the container bottom 104 to form the hinged container 100. The hinge ring 106 operably hingedly secures the container lid 102 to the container bottom 104 such that the two components may pivot via the hinge ring 106 between a closed condition (FIG. 1) and an open condition (FIG. 2).

Figure 4:
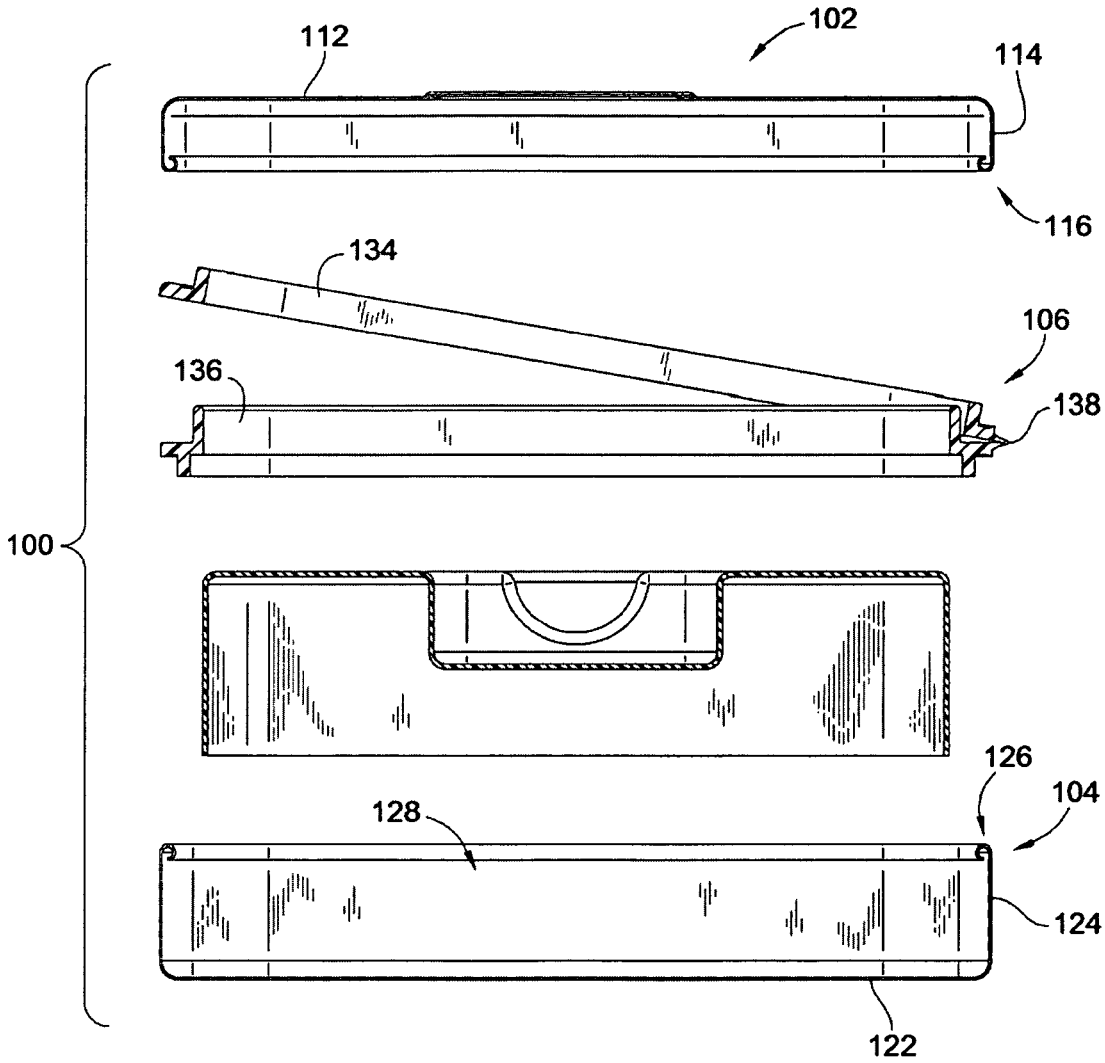
FIG. 4 is a cross-sectional exploded illustration of the container of FIG. 1.

Each of the container lid 102 and container bottom 104 is preferably formed from a thin metal body that is typically deep drawn. As illustrated in the exploded cross-sectional illustration of FIG. 4, the container lid 102 has a closed end 112, an annular upstanding wall 114 (also referred to as a sidewall) that includes a terminating formed edge 1 16. The upstanding wall 114 and closed end 112 combine to form a cavity 1 18. As used herein, the term annular shall be broad enough to encompass continuous ring-like sidewalls or ring-like shapes with both curved sections as well as straight sections, which may include, but are not limited to, circular, polygonal, elliptic, or other shapes. As the container lid 102 is preferably deep drawn, container lid 102 is a continuous one-piece construction that is desirably free of voids. Similarly, the container bottom 104 has a closed end 122, an annular upstanding wall 124 (also referred to as a sidewall) that includes a terminating formed edge 126. The upstanding wall 124 and closed end 122 combine to form a cavity 128. The container bottom 104 is also preferably a continuous one-piece construction that is desirably free of voids.

In the illustrated embodiment, the peripheral shape of the container lid 102 and container bottom 104 are matched such that the dimensions of the widths of the container lid 102 and container bottom 104 are identical in two dimensions. However, the depths of the container lid 102 and container bottom 104 may be the same or different than one another. In this configuration, aligned outer faces, such as, for example, faces 130 and 132 of the upstanding walls 114, 124 of the lid 102 and bottom 104, respectively, are substantially co-planar when the container 100 is assembled, see for example FIG. 5. In the illustrated embodiment, each of the four pairs of faces of the upstanding walls 114, 124 forming the rectangular shaped container 100 are co-planar within individual planes. This coplanar relationship for all for sets of sides of the container 100 is further illustrated in profile and plan view of the container 100 in FIGS. 11-16.

Figure 7:
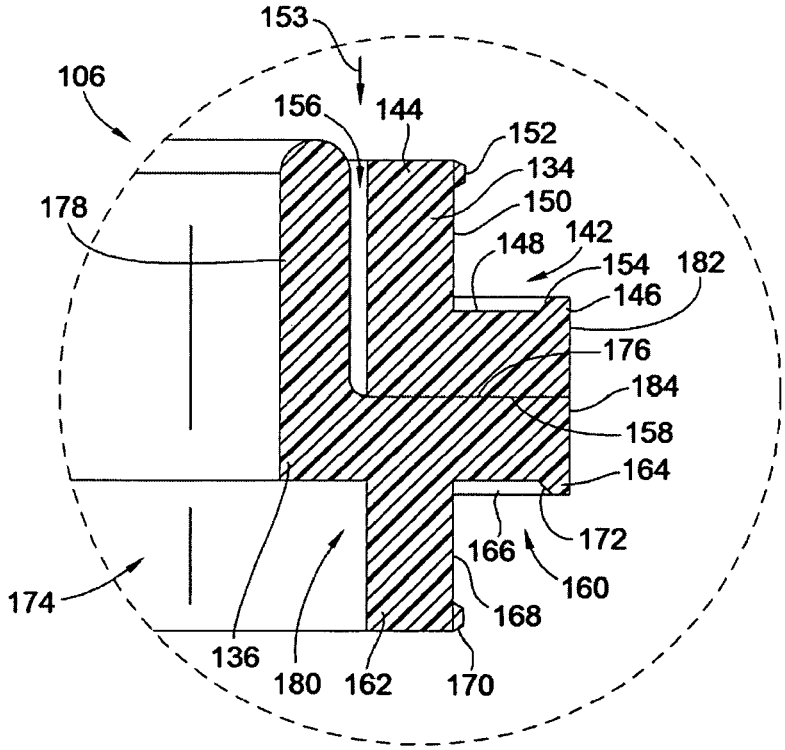
FIG. 7 is an enlarged partial cross-sectional illustration of one side of the hinge ring of FIG. 6 in a closed position.
Figure 8:
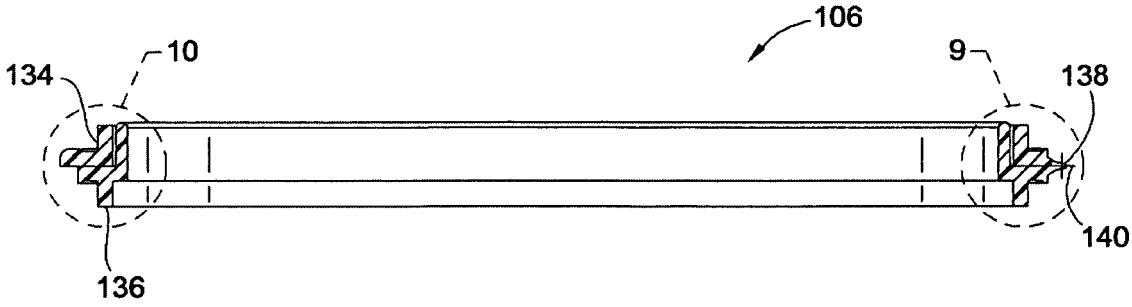
FIG. 8 is a further cross-sectional illustration of the hinge ring with the cross section taken through the center of the opening tab and living hinge.
Figure 9:
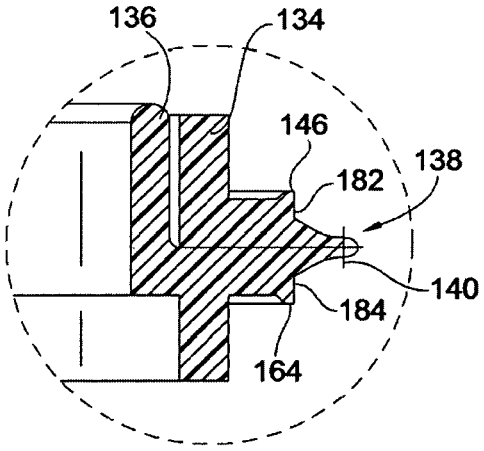
FIG. 9 is an enlarged partial cross-sectional illustration of the hinge ring of FIG. 8 illustrating the living hinge between the ring members.

With reference to FIGS. 6-10, the hinge ring 106 is a unitary body that includes two ring members 134, 136 that are coupled by an integral living hinge 138 (see FIGS. 8 and 9). The hinge 138 permits the two ring members 134, 136 to pivot relative to one another about an axis of rotation defined by cross-hair 140 between the open and closed positions illustrated in FIGS. 1 and 2, respectively.

With reference to FIG. 7, ring member 134 includes a channel 142 formed between a pair of annular inner and outer upstanding walls 144, 146 and a bottom wall 148. The inner and outer upstanding walls 144, 146 are generally parallel to one another. The channel 142, and upstanding walls 144, 146 are generally rectangular in shape and have four sides that define the rectangular shape of ring member 134. However, other shapes could be formed while remaining within the teachings of the present invention. Preferably, the container 100, in a closed condition, has a height of between about 0.5 inch and 2.5 inches, a width in one direction of between about 2 inches and 10 inches and a width in the other direction of between about 2 inches and 10 inches.

The outer surface 150 of the inner upstanding wall 144 that faces the outer upstanding wall 146 includes an outward extending or cantilevered projection 152. The projection 152 provides an undercut arrangement when viewed from the top of the hinge ring member 134 such as along arrow 153. The projection 152 may be formed by a plurality of individual segments extending about inner upstanding wall 144 or may be formed by a plurality of segments or nibs.

Inner upstanding wall 144 extends away from the bottom wall 148 a greater distance than outer upstanding wall 146. As illustrated, outer upstanding wall 146 includes a tapered inner surface 154 that generally faces inwards toward inner upstanding wall 144. The taper of the inner surface 154 is between about 30 degrees and 70 degrees relative to bottom 148 and more preferably between about 40 degrees and 60 degrees. As such, the outer upstanding wall 146 has a thicker base as compared to a distal end. The inner upstanding wall 144 bounds an aperture 156 passing through ring member 134. Ring member 134 includes a planar abutment surface 158 that is generally parallel to bottom wall 148 and that faces away from inner and outer upstanding walls 144, 146.

Ring member 136 includes a channel 160 formed between a pair of annular inner and outer upstanding walls 162, 164 and a bottom wall 166. The inner and outer upstanding walls 162, 164 are generally parallel to one another, i.e. equally spaced apart about the entire circumference of the ring member 136. The outer surface 168 of the inner upstanding wall 162 that faces the outer upstanding wall 164 includes an outward extending projection 170. The projection 170 provides an undercut arrangement when viewing the hinge ring member 136 in FIG. 7 in a direction opposite arrow 153. The projection 170 may be formed by a plurality of individual segments extending about inner upstanding wall 162 or may be formed by a plurality of segments or nibs. The channel 160, and upstanding walls 162, 164 are generally rectangular in shape and have four sides that define the rectangular shape of ring member 136. The four sides are connected by rounded corners.

Inner upstanding wall 162 extends away from the bottom wall 166 a greater distance than outer upstanding wall 164. As illustrated, outer upstanding wall 164 includes a tapered inner surface 172 that generally faces inwards toward inner upstanding wall 162. The inner upstanding wall 162 bounds a portion of an aperture 174 passing through ring member 136. Ring member 136 includes a planar abutment surface 176 that is generally parallel to bottom wall 166 and that faces away from inner and outer upstanding walls 162, 164.

Unlike ring member 134, ring member 136 further includes a bottom wall 178 that extends away from abutment surface 176 and inner and outer upstanding walls 162, 164. The bottom wall 178 bounds a portion of aperture 174 passing through ring member 136. Bottom wall 178 is laterally offset inward from the inner upstanding wall 162 forming a stepped region 180.

As illustrated in FIGS. 6-10, the resilient hinge ring 106 is in a closed position. In the closed position, bottom wall 178 of ring member 136 is received by aperture 156 of ring member 134 in such a manner that inner upstanding wall 144 of ring member 134 is positioned in surrounding relation of bottom wall 178. In this closed position, ring members 134, 136 are positioned in a back-to-back orientation with abutment surface 158 facing and abutting abutment surface 176. Further yet, in the closed position, the outer surfaces 182, 184 of the outer upstanding walls 146 and 164 are generally co-planar providing a smooth outer surface (see FIG. 7).

With reference to FIG. 9, the ring members 134, 136 are connected to one another by hinge 138. Hinge 138 extends outward from outer surfaces 182, 184 of the outer upstanding walls 146, 164. The two ring members 134, 136 can pivot between a closed position (FIG. 1) and an open position (FIG. 2).

Figure 10:
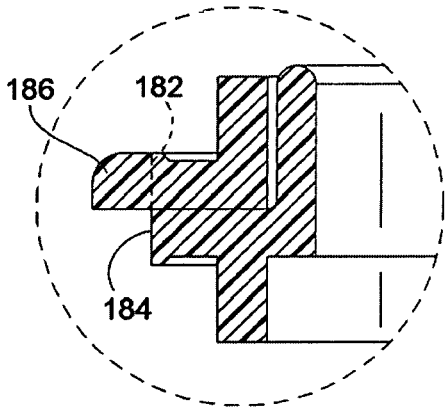
FIG. 10 is an enlarged cross-sectional partial illustration of the hinge ring of FIG. 8 illustrating the opening tab of the hinge ring.

As illustrated in FIGS. 1 and 10, ring member 134 of the illustrated embodiment further includes a opening tab 186 that extends outward from outer surface 182 (illustrated as a dashed line in FIG. 10) beyond outer surface 184 of ring member 136 to provide a tab for a user to engage when opening the resilient hinge ring 106. The opening tab 186 is positioned on a portion of upstanding wall 146 that is opposite hinge 138.

Figure 5:
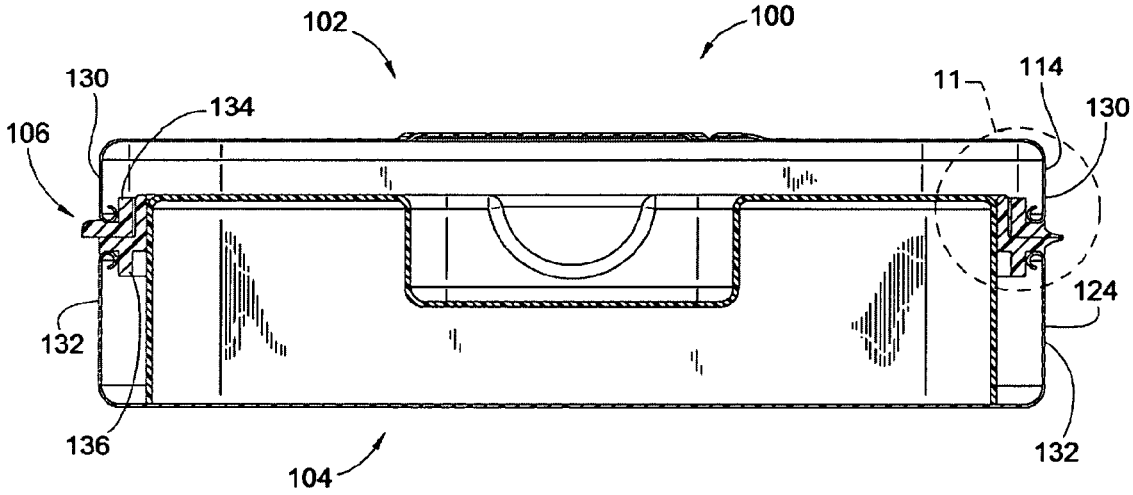
FIG. 5 is a cross-sectional illustration of the container of FIG. 1 in an assembled and closed orientation.
Figure 6:
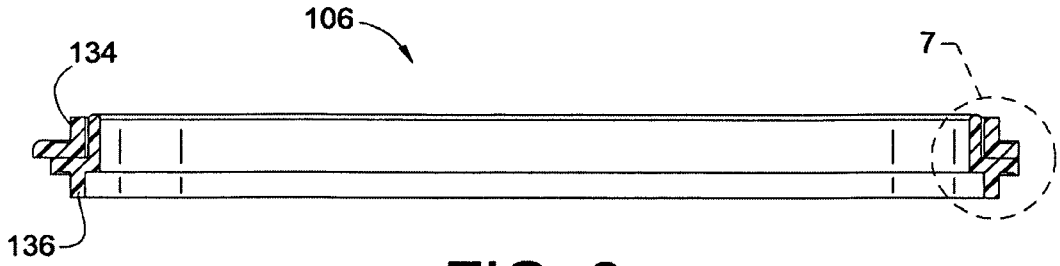
FIG. 6 is a cross-sectional illustration of the hinge ring of the container of FIG. 1.
Figure 11:
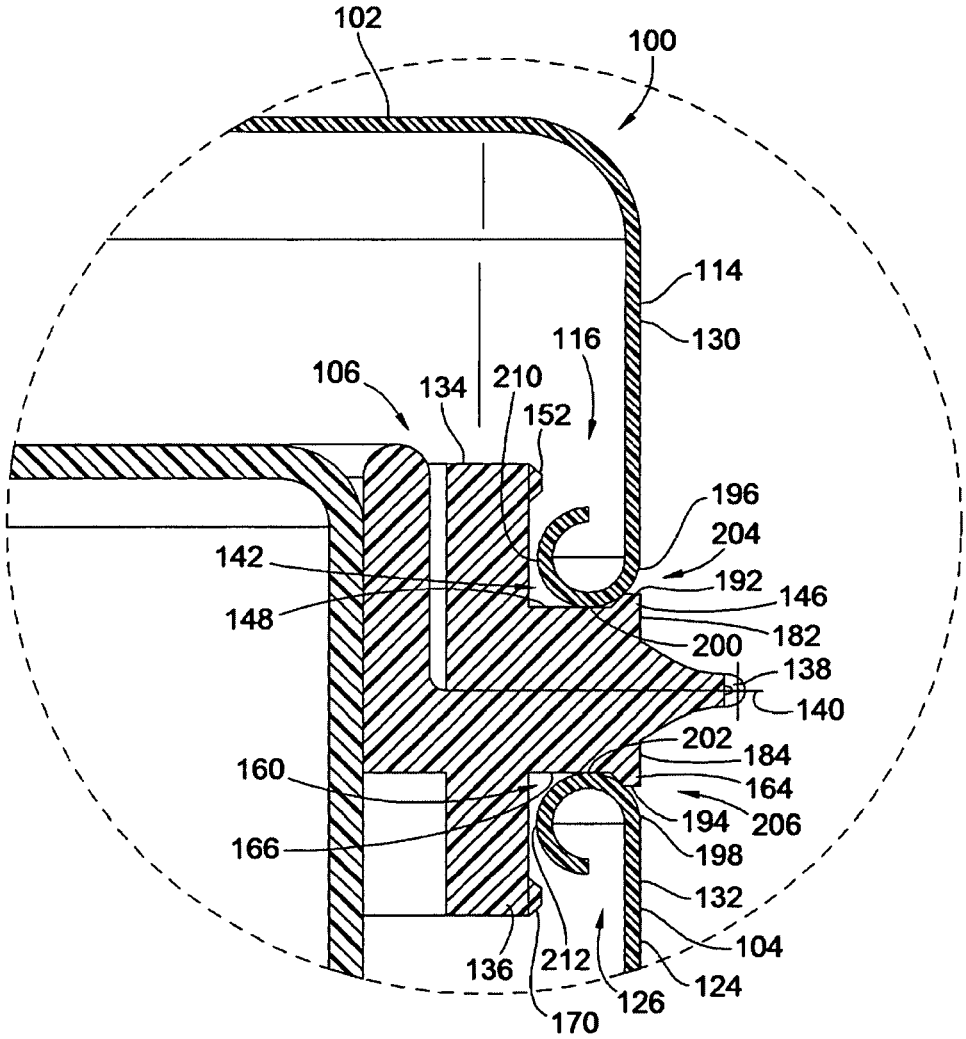
FIG. 11 is an enlarged partial cross-sectional illustration of the container of FIG. 1 illustrating the connection between the container lid and the container bottom by the hinge ring.
Figure 12:
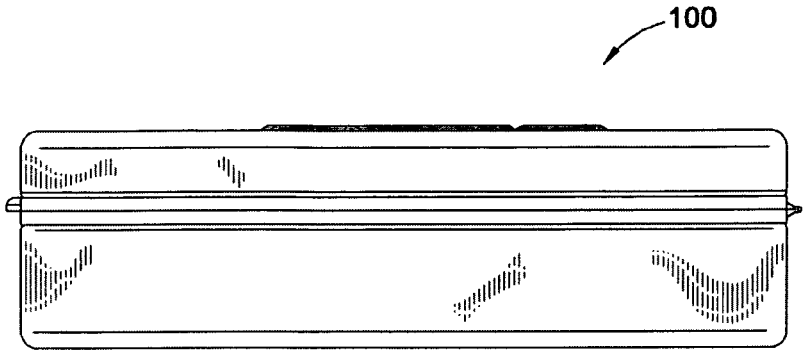
FIG. 12 is a left-side profile illustration of the container of FIG. 1.
Figure 13:
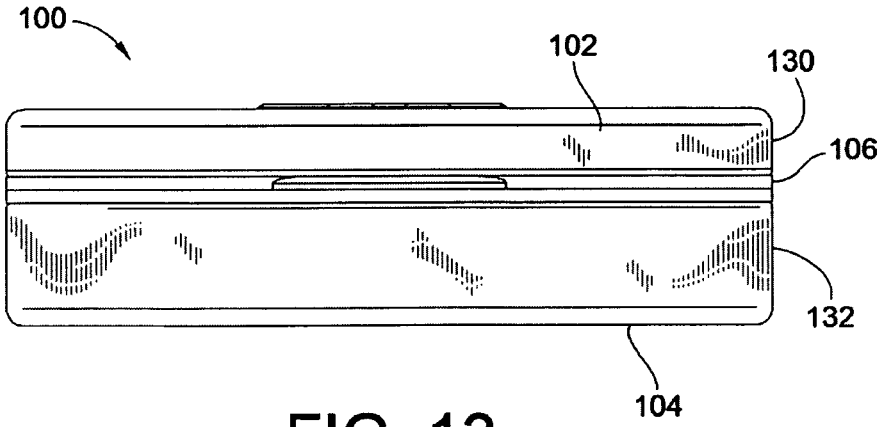
FIG. 13 is a front profile illustration of the container of FIG. 1.
Figure 14:
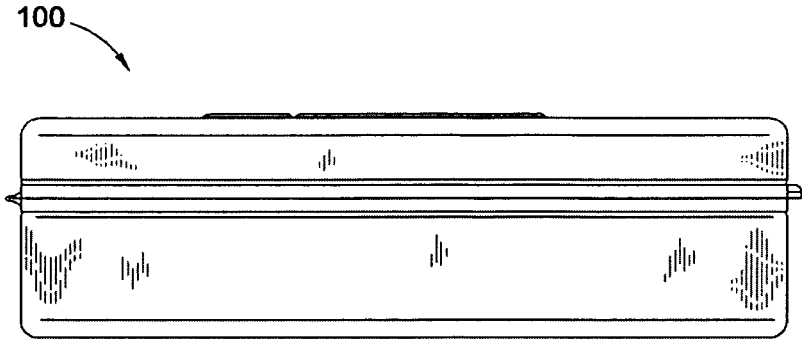
FIG. 14 is a right-side profile illustration of the container of FIG. 1.
Figure 15:
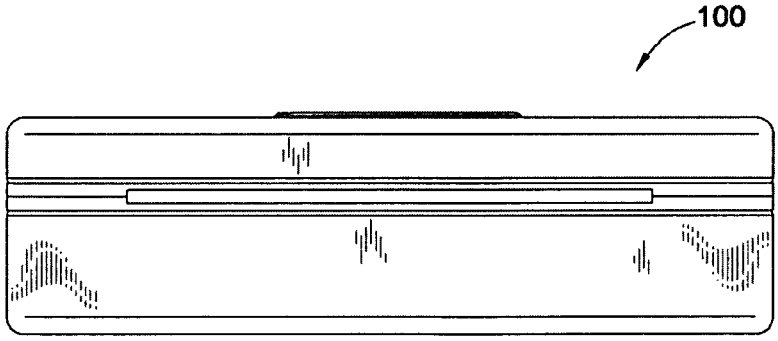
FIG. 15 is a rear profile illustration of the container of FIG. 1.
Figure 16:
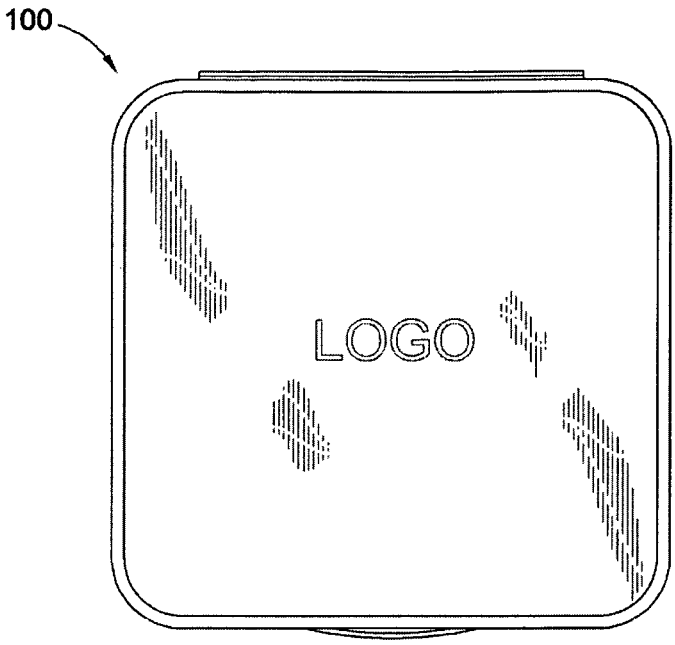
FIG. 16 is a top plan view of the container of FIG. 1.
Figure 17:
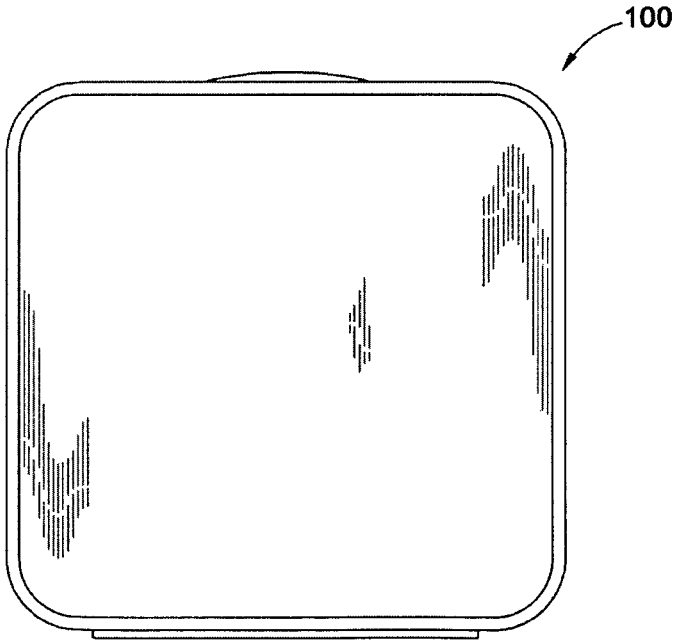
FIG. 17 is a bottom view of the container of FIG. 1.
Figure 18:
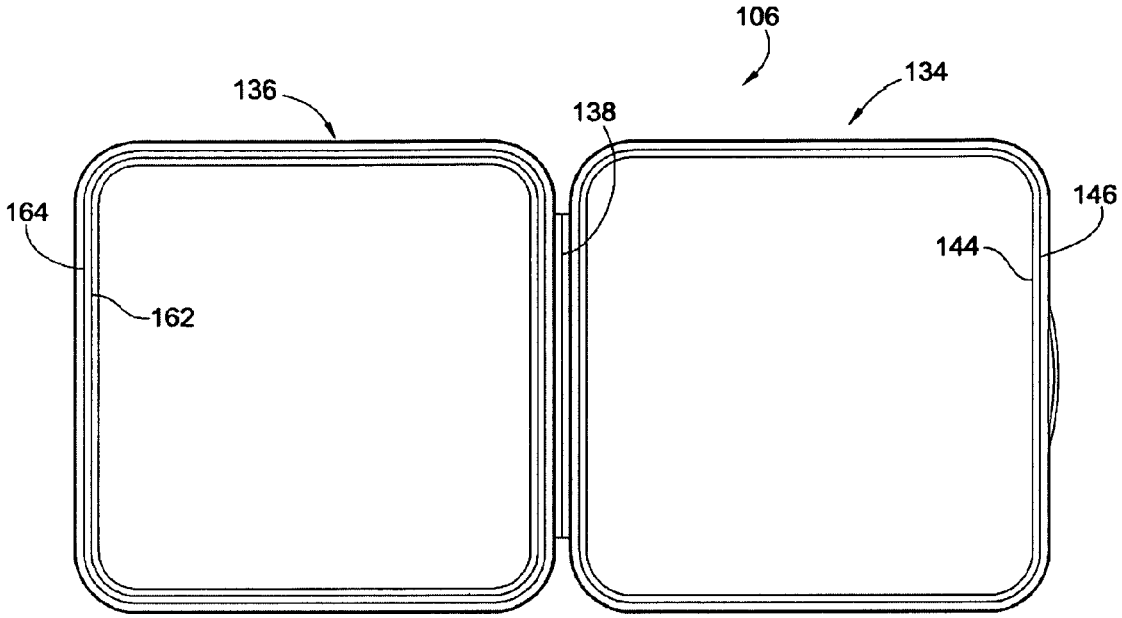
FIG. 18 is plan view of the hinge ring of FIG. 1 in an open position.
Figure 19:
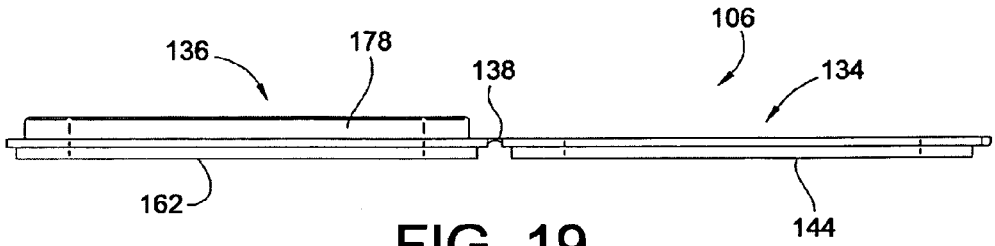
FIG. 19 is a side view illustration of the hinge ring of FIG. 1 in an open position.

As illustrated in FIGS. 5, 11 and 12, the hinge ring 106 secures the container lid 102 to the container bottom 104 such that the two components can pivot between a closed position and an open position via living hinge 138. Formed edges 116 and 126 engage ring members 134, 136, respectively, to secure the container lid 102 and container bottom 104 to the hinge ring 106 to form the container 100. In the illustrated embodiment, the formed edges 116, 126 are generally pennanular having a generally constant radius. However other embodiments can be incorporated where the formed edge has a different cross-sectional profile such as an ellipse or a hem. A hem being a folded over portion of the upstanding walls 114, 124 that is press back against an inner surface of upstanding walls 114, 124. Alternatively, the formed edge could merely be a laterally inward projecting flange.

In the illustrated embodiment and primary reference to FIG. 11, the formed edges 116, 126 are partially received by channels 142, 160. The upstanding walls 144, 146, 162, 164 and bottoms 148, 166 forming channels 142, 160 form an upward facing seat and a downward facing seat for receiving formed edges 116, 126, respectively. However, any one of the surfaces forming channels 142, 160 can act as a seat depending on the coupling of the container lid 102 and container body 104 to the hinge ring 106. For example, the formed edges could only contact the inner upstanding walls 146, 164 and not the channel bottoms of the upward and downward facing seats. In alternative embodiments, the upward and downward facing seats need not include the outer upstanding walls 144, 162.

It is desirous to have only a limited amount of hinge ring 106 extend outward beyond the outer faces 130, 132 of the container lid 102 and container bottom 104, and most preferably only the hinge 138 or opening tab 186. As such, the formed edges 116, 126 are configured such that the outer surfaces 182, 184 of the outer upstanding walls 146, 164 align in a co-planar orientation with the outer surfaces 130, 132 of upstanding walls 114, 124. As used herein co-planar, co-planar orientation, or vertically aligned shall refer to the condition that a line running substantially perpendicular to closed ends 112 122 is substantially contained by the outer upstanding walls 146, 164 and outer surfaces 130, 132, except for any voids that are formed between adjacent structures or interruptions resulting from the living hinge 138 or handle 186. Thus, the corners of the container can have a "co-planar" orientation even though only a single line segment of the entire plane would be shared by the various components.

To accommodate this co-planar arrangement, upstanding wall 114 is axially aligned, at least in part, with outer upstanding wall 146 and upstanding wall 124 is axially aligned, at least in part, with outer upstanding wall 164. Further yet, outer upstanding walls 146, 164 of the ring members 134, 136 are axially interposed between upstanding walls 114, 124 of the container lid 102 and container bottom 104 when the container 100 is in a closed condition. In this orientation, the distal ends 192, 194 are axially positioned between the transition points 196, 198 between the formed edges 116, 126 and the corresponding upstanding walls 114, 124 and the axial apogees 200, 202 of the formed edges 116, 126. As used herein, the term "axial apogee" shall refer to the portion of a formed edge that is positioned the furthest most extent away from the closed ends of the corresponding container lid or container bottom.

As the distal ends 192, 194 are generally truncated, cavities or voids 204, 206 are formed between the formed edges 116, 126 and outer upstanding walls 146, 164.

Because the formed edges 116, 126 of the container lid 102 and container bottom 104 are substantially identical, they can be inserted into either of the upper or lower channels 142, 160 and either of the container lid 102 and container bottom 104 can be designated as the top or bottom of the container.

In a preferred embodiment, the apogees 200, 202 axially abut bottoms 148, 166 of channels 142, 160 when the container lid 102 and container bottom 104 are secured to the hinge ring 106. Further yet, a laterally innermost portion 210, 212 of the formed edges 116, 126 extends laterally into a corresponding one of the undercuts formed by projections 152 and 170 to axially secure the corresponding container lid 102 or container bottom 104 to ring members 134, 136.

While the illustrated embodiment includes projections 152 and 170 to grip or engage the formed edges 116, 126, other means of gripping or engaging the formed edges 116, 126 may be employed. For example, the formed edges 116, 126 may be formed such that they engage outer surfaces 150, 168 of upstanding walls 144, 146 as the container lid 102 and container bottom 104 are axially connected to hinge ring 106. This engagement may create a friction fit connection, as opposed to the interference fit connection provided by the inclusion of projections 152, 170, between the container lid 102 or container bottom 104 with the hinge ring 106. Further yet, other means of connecting the container lid and container bottom to the hinge ring 106 may be employed. For example, an adhesive may be applied between the two components.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A metal container comprising:

a container lid and container bottom each having a closed bottom and an annular sidewall terminating in a formed edge, the formed edges of the container lid and container bottom defining a peripheral container shape;

a hinge ring pivotally securing the container lid to the bottom, the hinge ring having first and second continuous ring members and a living hinge integrally joining the ring members, the first ring member having an upward facing seat sized to securably engage the formed edge of the container lid and the second ring member having a downward facing seat sized to securably engage the formed edge of the container bottom; and wherein the container lid securably connects to the first ring member and the container bottom securably connects to the second ring member; and wherein an outer surface of the first ring member is generally flush with an outer surface of the annular sidewall of the container lid and wherein an outer surface of the second ring member is generally flush with an outer surface of the annular sidewall of the container bottom.

2. The metal container of claim 1, wherein one of the first and aperture formed by the other one of the first and second ring members, the other one of the first and second ring members surrounding the inner sidewall.

3. The metal container of claim 1, wherein the container lid is securably engaged with the first ring member in the open position and the closed position and the container bottom is securably engaged with the second ring member in the open position and the closed position.

4. The metal container of claim 1, wherein the upward facing and downward facing seats are each formed by individual channels each channel bounded by a pair of annular inner and outer walls extending from a channel bottom, the formed edges begin at a transition point where the sidewalls transition from being substantially perpendicular to the closed bottoms, wherein in a closed position, the formed edges face one another and form a gap between the transition points, wherein the outer walls are positioned with in the gap and are axially interposed between the transition points.

5. The metal container of claim 4, wherein distal ends of the outer walls are axially positioned between the transition point and an axial apogee of the formed edge of the corresponding sidewall.

6. The metal container of claim 5, wherein the outer surface of the sidewalls and the outer walls are generally co-planar.

7. The metal container of claim 6, wherein the living hinge interrupts the co-planar configuration of a portion of the outer periphery of the metal container.

8. The metal container of claim 1, wherein the container lid and container bottom are metal and the hinge ring is plastic.

9. A metal container comprising:

a container lid and container bottom each having a closed bottom and an annular sidewall terminating in a formed edge the formed edges of the container lid and container bottom defining a peripheral container shape;

a hinge ring pivotally securing the container lid to the bottom, the hinge ring having first and second continuous ring members and a living hinge integrally joining the ring members, the first ring member having an upward facing seat sized to securably engage the formed edge of the container lid and the second ring member haying a downward facing seat sized to securably engage the formed edge of the container bottom;

wherein the container lid securably connects to the first ring member and the container bottom securably connects to the second ring member, wherein the upward facing and downward facing seats are each formed by individual channels each channel bounded by a pair of generally parallel inner and outer walls extending from a channel bottom, the channel of the upward facing seat extending the entire peripheral container shape of the container lid and the channel of the downward facing seat extending the entire peripheral container shape if the container bottom; and wherein the formed edges of the container lid and container bottom are inward rolled end portions of the container lid and container bottom, the rolled end portions being seated in the channels with the outer surface of the outer walls aligned with the outer surfaces of the sidewalls such that the outer surfaces of the outer walls and the outer surfaces of the sidewalls are generally flush.

10. The metal container of claim 9, wherein the outer surfaces of the sidewalls of the lid container and the container bottom align and are co-planar with the outer surfaces of the first and second ring members.

11. The metal container of claim 10, wherein the formed edges begin at a transition portion where the sidewalls transition from being substantially planar to arcuate, and wherein the outer walls are axially interposed between the transition portions. second ring members includes an annular inner sidewall extending axially away from the seat of the one of the first and second ring members, the inner sidewall extending axially into an 12. The metal container of claim 9, wherein one of the first and second ring members includes a handle projecting outward from the outer surface thereof outward beyond the outer surfaces of the container lid and container bottom; and wherein the hinge extends outward from the outer surfaces of the first and second ring members outward beyond the outer surfaces of the container lid and container bottom.

13. The metal container of claim 9, wherein the inner walls include an outward extending projection axially spaced from the channel bottom from which the inner wall extends forming an undercut between the projection and the channel bottom, the formed edge of the corresponding container lid or container bottom extending laterally into the undercut providing an interference engagement between the formed edge and the projection opposing disengagement of the container lid and container bottom from the hinge ring.

14. The metal container of claim 13, wherein at least one of the inner walls and the sidewalls is sufficiently resilient to permit sufficient flexure to permit the container lid and container bottom to be press fit over the projections.

15. A hinged connector for joining a metal container lid and a metal container bottom to formed a hinged container, the container lid having a formed edge of a first given size and shape, the container bottom having a formed edge of a second given size and shape, the formed edge of the container lid defining a first peripheral shapes and the formed edge of the container bottom defining a second peripheral shape, the hinged connector comprising:

first and second ring members joined by an integrally formed hinge, the first ring member being shaped to match the first peripheral shape and the second ring member being shaped to match the second peripheral shape;

the first ring member forming a continuous structure bounding an aperture therethrough, the first ring member having an upward facing upper seat for receiving the formed edge of the container lid, the upward facing upper seat extendin along all sides of the first ring member, the upward facing upper seat being on an opposite side of the first ring member as a first abutment surface:

the second ring member forming a continuous structure bounding an aperture therethrough, the second ring member having a downward facing bottom seat for receiving the formed edge of the container bottom, the downward facing bottom seat extending along all sides of the second ring member, the downward facing bottom seat being on an opposite side of the second ring member as a second abutment surface;

the first and second abutment surfaces facing one another he hinged connector is in a closed orientation;

wherein the upward facing upper seat is a first channel formed by a first bottom wall and first inner and outer upstanding walls extending away from the first bottom wall, the first inner and outer upstanding walls being spaced apart from and generally parallel to one another; the downward facing bottom seat is a second channel formed by a second bottom wall and second inner and outer upstanding walls extending away from the second bottom wall; and wherein the first outer upstanding wall extends away from the first bottom wall a shorter distance than the first inner upstanding wall and the second outer upstanding wall extends away from the second bottom wall a shorter distance than the second inner upstanding wall.

16. The hinged connector of claim 15, wherein a first inner surface of the first outer upstanding wall that faces the first inner upstanding wall tapers away from the first upstanding wall when extending from the first bottom wall toward a distal end of the first outer upstanding wall and wherein a second inner surface of the second outer upstanding wall that faces the second inner upstanding wall tapers away from the second upstanding wall when extending from the second bottom wall toward a distal end of the second outer upstanding wall.

* * * * *

UNITED STATES PATENT AND TRADEMARK OFFICE

CERTIFICATE OF CORRECTION

PATENT NO. : 8,485,390 B2
APPLICATION NO. : 12/168389
DATED : July 16, 2013
INVENTOR(S) : Edward P. Cronin It is certified that error appears in the above-identified patent and that said Letters Patent is hereby corrected as shown below:

In the Claims

Column 8, Lines 49-50, Claim 2
After "first and" and before "aperture formed" the following should be added -- second ring members includes an annular inner sidewall extending axially away from the seat of the one of the first and second ring members, the inner sidewall extending axially into an --.

Column 9, Line 15, Claim 9
A -- , -- should be inserted after -- edge --.

Column 9, Line 23, Claim 9
The word "haying" should correctly read -- having --.

Column 9, Line 35, Claim 9
The word "if" should correctly read -- of --.

Column 9, Lines 51-54, Claim 11
Delete the phrase "second ring members includes an annular inner sidewall extending axially away from the seat of the one of the first and second ring members, the inner sidewall extending axially into an".

Column 10, Line 40, Claim 15
The word "he" should correctly read -- when --.

Signed and Sealed this
First Day of October, 2013

Teresa Stanek Rea
*Deputy Director of the United States Patent and Trademark Office*